US006840742B2

(12) United States Patent
Cohen et al.

(10) Patent No.: US 6,840,742 B2
(45) **Date of Patent: *Jan. 11, 2005**

(54) FAN ASSEMBLY FOR AN UMBRELLA

(75) Inventors: Ronald B. Cohen, Hopkinton, MA (US); Wayne Wallen, Amston, CT (US)

(73) Assignee: New Products Too, LLC, Westborough, MA (US)

( * ) Notice: Subject to any disclaimer, the term of this patent is extended or adjusted under 35 U.S.C. 154(b) by 113 days.

This patent is subject to a terminal disclaimer.

(21) Appl. No.: 10/193,879

(22) Filed: Jul. 12, 2002

(65) Prior Publication Data

US 2003/0102021 A1 Jun. 5, 2003

Related U.S. Application Data

(63) Continuation-in-part of application No. 10/006,097, filed on Dec. 4, 2001, now Pat. No. 6,732,752.

(51) Int. Cl.[7] ..... A45B 3/00
(52) U.S. Cl. ..... 416/244 R; 135/16
(58) Field of Search ..... 416/244 R, 146 R, 416/204 R; 417/313; 135/16

(56) References Cited

U.S. PATENT DOCUMENTS

| | | | | |
|---|---|---|---|---|
| 1,148,332 | A | | 7/1915 | Onyskow |
| 3,177,881 | A | | 4/1965 | Covington |
| 5,007,811 | A | | 4/1991 | Hopkins |
| 5,172,711 | A | | 12/1992 | Mueller et al. |
| 5,273,062 | A | | 12/1993 | Mozdzanowski |
| 5,349,975 | A | | 9/1994 | Valdner |
| 5,765,582 | A | | 6/1998 | Molnar, IV |
| 5,887,771 | A | | 3/1999 | Perry |
| D409,369 | S | | 5/1999 | Vega |
| 5,967,161 | A | | 10/1999 | Neal |
| RE36,514 | E | * | 1/2000 | Clark |
| 6,017,188 | A | | 1/2000 | Benton |
| 6,027,309 | A | | 2/2000 | Rawls et al. |
| 6,230,723 | B1 | * | 5/2001 | Hixson |
| 6,325,084 | B1 | * | 12/2001 | Cohen |

FOREIGN PATENT DOCUMENTS

| | | | | |
|---|---|---|---|---|
| RO | 108408 | * | 5/1994 | ..... A45B/11/04 |

* cited by examiner

*Primary Examiner*—Robert Canfield
(74) *Attorney, Agent, or Firm*—Iandiorio & Teska

(57) ABSTRACT

A fan assembly with a split collar clampable about a pole, the split collar including a drive ring support. A split motor housing is clampable about the split collar and the split motor housing includes a drive mechanism. A split drive ring is rotatably clampable about the split collar and supported by the drive ring support. The split drive ring includes a driven mechanism driven by the drive mechanism. A plurality of fan blades are coupled to the split drive ring.

27 Claims, 12 Drawing Sheets

FAN ASSEMBLY FOR AN UMBRELLA

PRIORITY CLAIM

This application is a Continuation-in-Part of application Ser. No. 10/006,097 filed Dec. 4, 2001, now U.S. Pat. No. 6,732,752, also entitled "Fan Assembly for an Umbrella".

FIELD OF THE INVENTION

This invention relates to a fan assembly for an umbrella and also to a fan assembly which can be coupled to a pole even without an umbrella.

BACKGROUND OF THE INVENTION

There has long been a need for a self-contained, easy to assemble, low cost, universal, and safe umbrella fan. The design constraints associated with such an umbrella fan include the fact that the umbrella canopy is often lowered when not in use by the action of a slide which surrounds the umbrella pole operated by a crank mechanism which also surround the umbrella pole. Thus, any useful after-market umbrella fan assembly must be able to be easily coupled by the consumer to the umbrella pole between the crank mechanism and the umbrella canopy slide.

U.S. Pat. No. 6,017,188 discloses a fan assembly permanently disposed on the umbrella pole above the slide. Accordingly, this assembly is not designed as an after-market fan which can be used in conjunction with a wide variety of umbrellas previously purchased by consumers.

U.S. Pat. No. 5,007,811 discloses a fan assembly supported on an umbrella pole below the umbrella slide but requires, in each embodiment, bearings supporting the integral rotatable drive ring to which the fan blades are attached. In one embodiment, the large drive gear of the rotatable drive ring and the drive ring itself have a slot therethrough for receiving the umbrella shaft. To compensate for this slot, either two opposing drive pinions are required (one on either side of the slot) or, instead, a special gear key is required to fill the gap in the drive gear, and, in that embodiment, only one drive pinion is required.

The '811 patent also purports to show an embodiment where the drive gear and the drive ring are split and pivot about a hinge. Still, even in this embodiment, the bearings supporting the rotatable drive ring are still required as part of the fan assembly housing. Since, in the design of the '811 patent, the drive ring is an integral part of the fan motor housing, the resulting structure is necessarily complex and difficult to manufacture at a low cost. Finally, the '188 patent notes that the fan assembly of the '811 patent is unstable.

SUMMARY OF THE INVENTION

It is therefore an object of this invention to provide a self-contained after-market fan assembly for umbrellas.

It is a further object of this invention to provide such a fan assembly which is easy to assemble.

It is a further object of this invention to provide such a fan assembly which can be manufactured and sold at a low cost.

It is a further object of this invention to provide such a fan assembly which is universal in design and which can accommodate different umbrella pole diameters and a variety of umbrella configurations.

It is a further object of this invention to provide such a fan assembly which can be easily slid down or decoupled from the umbrella pole when the umbrella canopy is folded down and not in use and then slid back up the umbrella pole and into position or coupled to the pole when the umbrella canopy is deployed.

It is a further object of this invention to provide such a fan assembly which has easily removable contoured fan blades.

It is a further object of this invention to provide such a fan assembly which is battery operated.

It is a further object of this invention to provide such a fan assembly which does not require multiple drive pinions or a special gear key.

It is a further object of this invention to provide such a fan assembly in which the drive ring is not an integral part of the fan motor housing and thus requires no rotatable bearings.

The invention results from the realization that a self contained, universal, and low cost, umbrella fan assembly which is easy to assemble and disassemble is preferably effected by three separate assemblies: a split collar clampable around the umbrella pole, a motor housing supported by the split collar, and a separate fan blade drive ring with an integral gear also supported by the split collar. This preferred design is in sharp contrast with the assembly of U.S. Pat. No. 5,007,811 in which the drive ring is an integral part of the motor housing and thus requires expensive bearings and a complex drive train to accommodate the slot in the motor housing.

This invention features a fan assembly comprising a split collar clampable about a pole, the split collar including a drive ring support, a split motor housing clampable about the split collar, the split motor housing including a drive mechanism, a split drive ring rotatably clampable about the split collar and supported by the drive ring support, the split drive ring including a driven mechanism driven by the drive mechanism, and a plurality of fan blades coupled to the split drive ring.

In the preferred embodiment, the driven mechanism is a driven gear extending downward and supported on the drive ring support and the drive mechanism is a drive gear located adjacent the drive ring support. Also, the split collar also typically includes a motor housing support in the form of a circumferential platform extending outwardly from the split collar. Typically, the drive ring support is a circumferential lip extending outwardly from the split collar.

In one embodiment, the split collar includes two sections each section including upper and lower clasp members. Also, the split collar motor housing support platform may include a cut-out for receiving the motor of the split motor housing. Typically, the split motor housing further includes batteries for powering the motor thereof. The split motor housing may include two sections, each section also including opposing clasp members. The split drive ring may also include two sections, each section including opposing clasp members.

The split drive ring typically includes fan blade blocks for removably coupling the fan blades to the split drive ring. Each fan blade then has a tang connectable to the split drive ring, the tang configured to extend the fan blade out over the split motor housing and each tang has a twist to angle the fan blades. Also, the fan blade blocks typically each include an upwardly biased spring member for releasably retaining the distal end of each fan blade. A safety clamp may also be included as well as a speaker for emitting sounds.

This invention also features a fan assembly comprising a split collar clampable about a pole, the split collar including a drive ring support, a split motor housing clampable about the split collar, the split motor housing including a drive gear, a split drive ring clampable about the split collar, the split drive ring including a driven gear extending downwardly and supported on the drive ring support and driven by the drive gear of the split motor housing, and a plurality of fan blades coupled to the split drive ring.

Typically, the split collar is removably clampable about a pole, the split collar includes a circumferential drive ring supporting lip extending outwardly from the split collar and a circumferential platform extending outwardly from the split collar forming a motor housing support. The split motor housing is removably clampable about the split collar and supported on the circumferential platform of the split collar. The split motor housing includes a drive mechanism and the split drive ring is removably clampable about the split collar and rotatably supported by the circumferential lip of the split collar. The split drive ring includes a driven mechanism driven by the drive mechanism of the split motor housing.

A preferred fan assembly in accordance with this invention features a split collar formed in at least two sections, each section including opposing upper and lower clasp members for releasably clamping the split collar about a pole. The split collar includes a drive ring support. A split motor housing is formed in at least two sections, each section including opposing clasp members for releasably clamping the split motor housing about the split collar. The split motor housing includes a drive mechanism. A split drive ring is formed in at least two sections, each section including opposing clasp members for rotatably clamping the split drive ring about the split collar. The split drive ring includes a driven mechanism driven by the drive mechanism of the split motor housing. The split drive ring is supported by the drive ring support of the split collar. A plurality of fan blades are coupled to the split drive ring.

One fan assembly in accordance with this invention features a collar clampable about a pole including a drive ring support. A motor housing is clampable about the collar and the motor housing includes a battery powered motor operated drive gear. A drive ring is clampable about the collar and the drive ring including a driven gear supported on the drive ring support and driven by the drive gear of the motor housing. A plurality of fan blades are releasably coupled to the drive ring.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
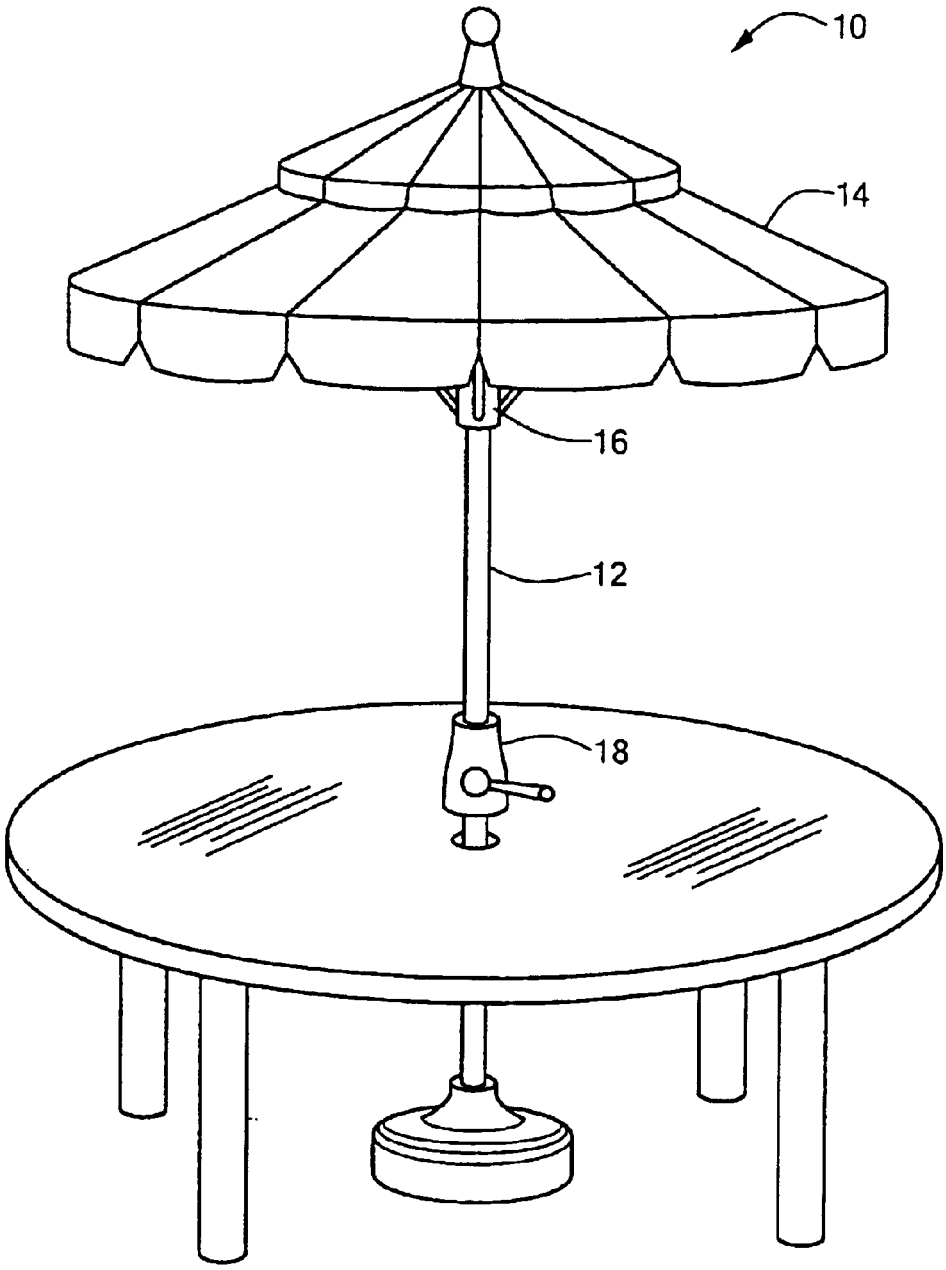
FIG. 1 PRIOR ART
FIG. 1 is a schematic view of a typical umbrella assembly.

Conventional umbrella 10, FIG. 1 includes pole 12 and canopy 14 which is lowered and raised as slide 16 moves up and down on pole 12 by the operation of crank mechanism 18.

Thus, many consumers have existing umbrellas which cannot accommodate a fan assembly unless it can be easily coupled about pole 12 between clamp mechanism 18 and slide 16. In addition, when umbrella 10 is not in use and canopy 14 is folded downward, the fan assembly must be moveable down the pole or easily decoupled from the pole so it does not interfere with the operation of slide 16. In addition, any after-market fan assembly design must take into account the fact that the umbrella is often lowered when not in use. Thus, the fan assembly must be easily coupled by the consumer to the pole between the crank mechanism and the slide but also quickly movable down or decoupled from the pole. In addition, any marketable fan assembly must be self-contained, low cost, universal in design, safe, and preferably battery operated to avoid the need for extension cords and the like. Any fan assembly which does not meet these design constraints will not be accepted by consumers.

Figure 2:
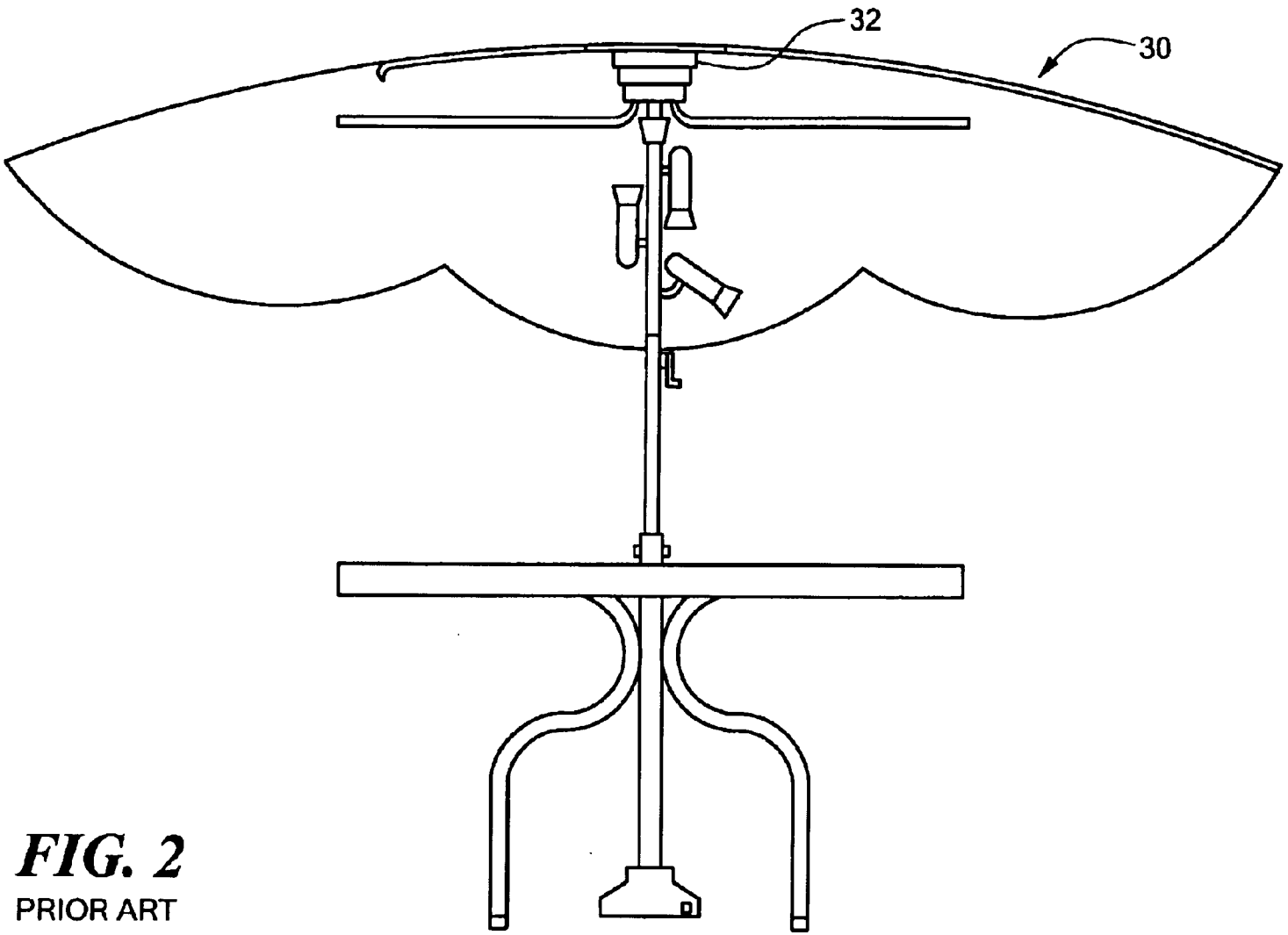
FIG. 2 PRIOR ART
FIG. 2 is a schematic view of a prior art patio table and pole fan combination in accordance with the prior art.

Umbrella 30, FIG. 2 with integral fan assembly 32 is disclosed in U.S. Pat. No. 6,017,188 incorporated herein by this reference. Unfortunately, fan assembly 32 must be incorporated as a component of umbrella 30 and thus, a consumer with umbrella 10, FIG. 1 cannot incorporate fan assembly 32, FIG. 2 therewith.

U.S. Pat. No. 5,007,811, also incorporated herein by this reference, discloses after-market fan assembly 40, FIG. 3. Unfortunately, assembly 40 is complex in design, expensive to manufacture, and unstable. Support 42 supports motor housing 44 thereon. Motor housing 44 then requires bearings 46 which, in turn, support integral fan blade drive ring 48 thereon. Drive gear 50 of drive ring 48 is driven by gear 52 which is coupled to motor M via gear train 54. The large drive gear of the rotatable drive ring (and the drive ring itself) have, in all the preferred embodiments, a slot therethough for receiving the umbrella shaft. To compensate for this slot, either two opposing drive pinions are required (one on either side of the slot) or, instead, a special gear key is required to fill the gap in the drive gear. As delineated in the Background section above, the '811 patent also purports to show an embodiment where the drive gear and the drive ring are split and pivot about a hinge. Still, even in this embodiment, bearings are required to support the rotatable drive ring and the drive ring itself forms an integral part of the fan assembly housing. Since, in the design of the '811 patent, the drive ring is an integral part of the fan motor housing, the resulting structure is necessarily complex, difficult to manufacture, and results in a costly fan assembly.

Figure 4:
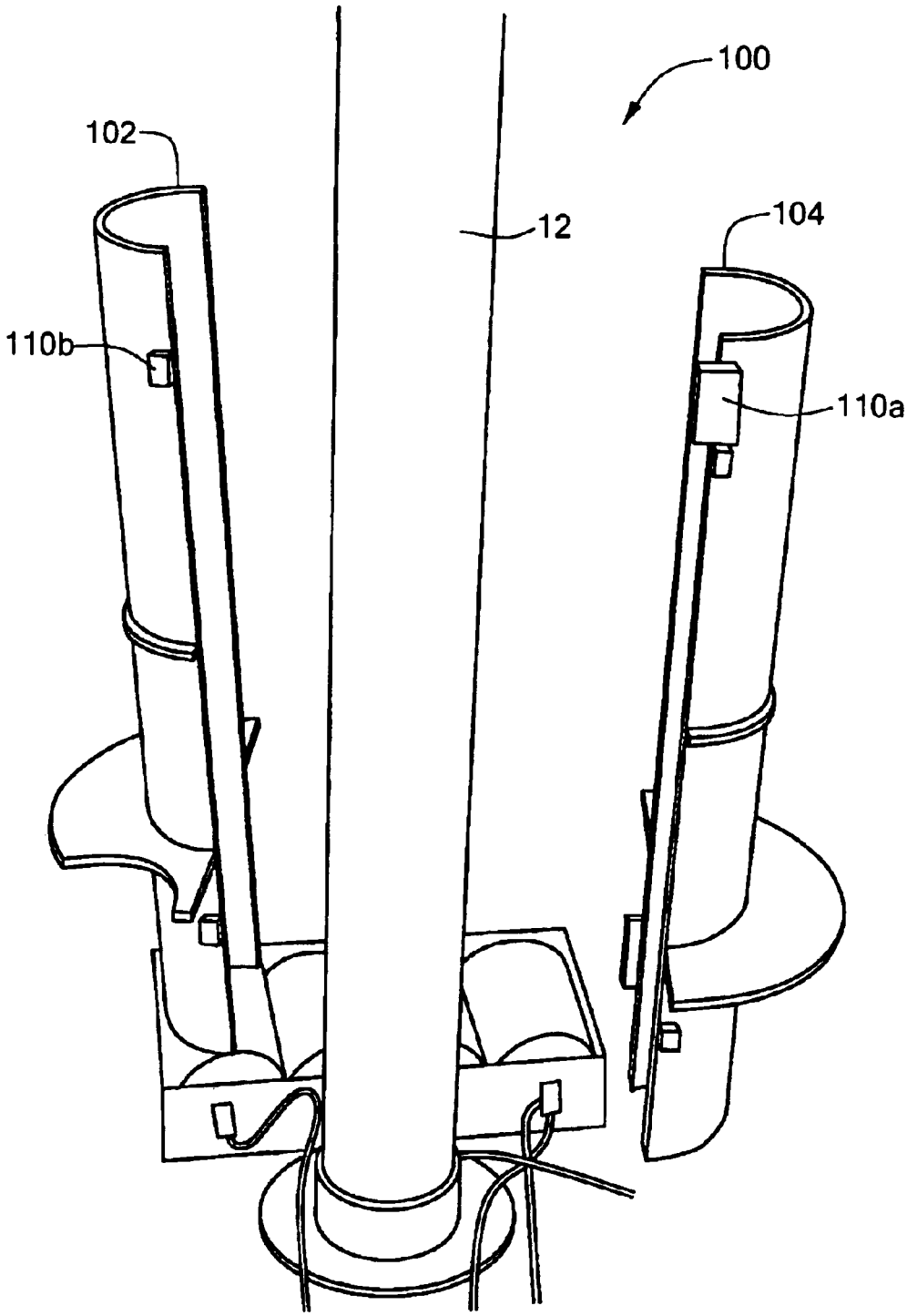
FIG. 4 is a schematic view of the preferred split collar of the subject invention just prior to being coupled about an umbrella pole.
Figure 5:
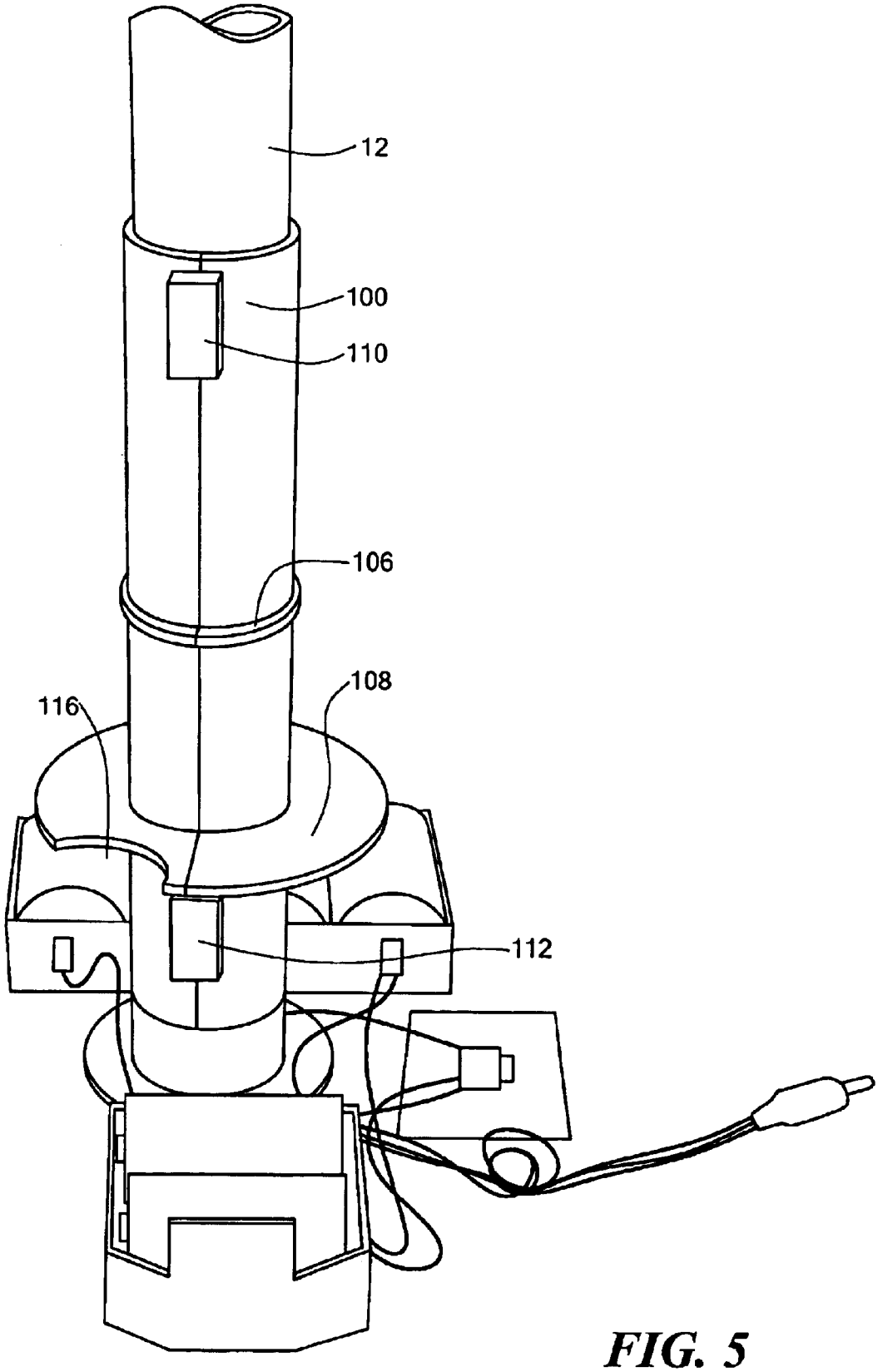
FIG. 5 is a schematic view of the split collar of FIG. 4 now assembled on the umbrella pole.

The prototype fan assembly of the subject invention features split collar 100, FIG. 4, typically in two sections 102 and 104 clampable about umbrella pole 12 as shown in FIG. 5. Split collar 100 includes drive ring support 106 preferably in the form of a circumferential lip extending outwardly from split collar 100 as shown and also motor housing support 108 typically in the form of a circumferential platform extending outwardly from split collar 100. Collar 100 can be made to fit a variety of umbrella poles by the inclusion of a foam sheath disposed between collar 100 and the umbrella pole to accommodate different diameter umbrella poles. Shims may also be provided to serve this purpose.

Upper clasp members 110 and lower clasp members 112 removably secure split collar 100 to pole 12. As shown in FIG. 1, section 104 includes one portion 110*a* of clasp member 112 and section 102 includes the other portion 110*b* of clasp member 110. There are typically two upper opposing clasp members 110, FIG. 5 and two lower opposing clasp members 112.

Figure 6:
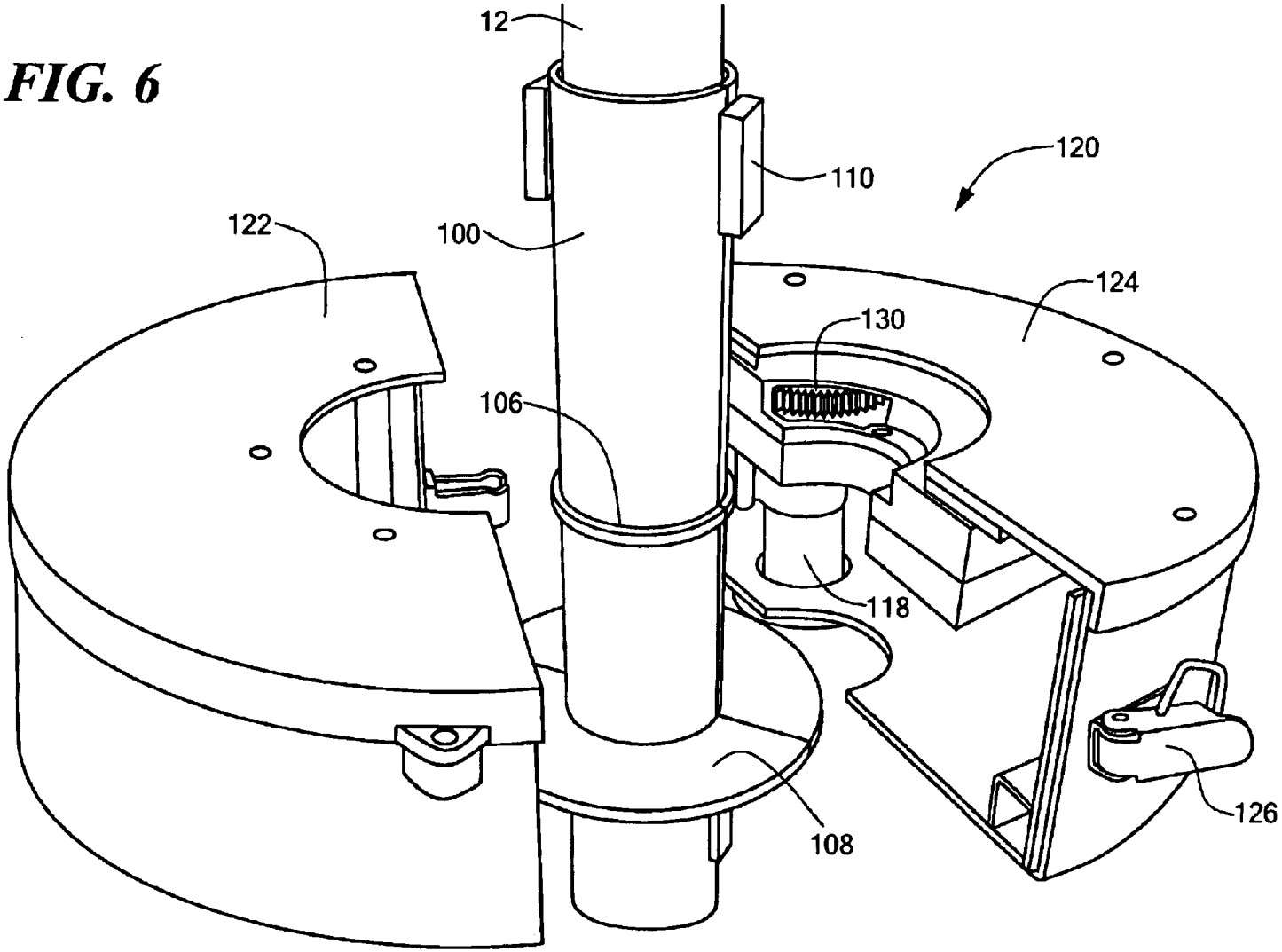
FIG. 6 is a schematic view of the preferred motor housing of the subject invention just prior to being coupled to the split collar.
Figure 7:
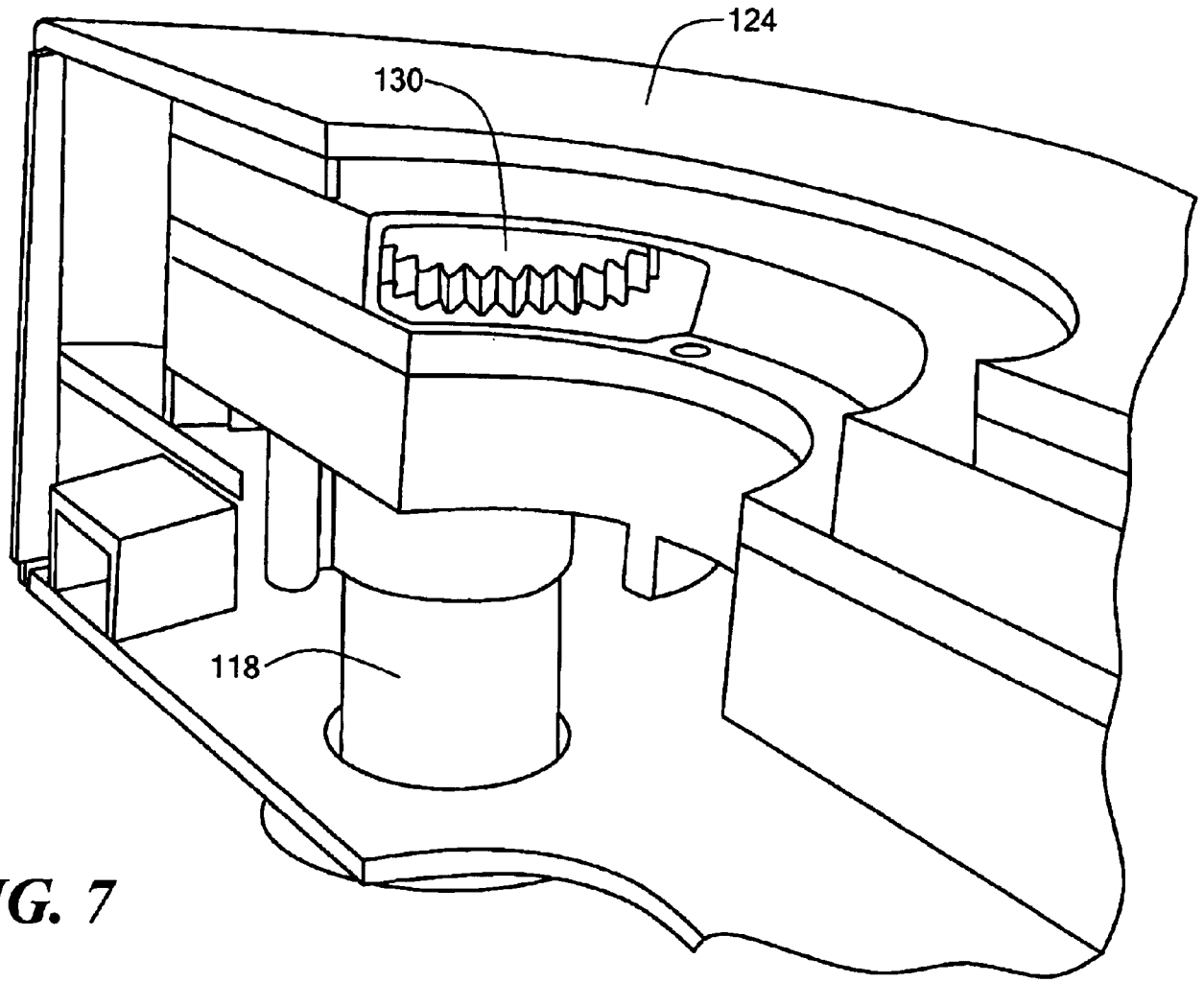
FIG. 7 is a partial schematic view of the motor housing drive gear of the subject invention.

Motor housing support platform 108 includes cutout 116 for motor 118, FIGS. 6–7 of the split motor housing 120. Split motor housing 120 is also typically formed in two sections 122, 124 each with two opposing clasp members such as clasp member 126. In this way, split motor housing 120 is removably clampable about split collar 100 and rests on motor housing support 108 thereof. Split motor housing 120 also includes a drive mechanism preferably in the form of drive gear 130 driven by battery powered DC motor 118 and positioned adjacent drive ring support 106 when split motor housing 120 is coupled to split collar 100 as shown in FIG. 8.

Figure 8:
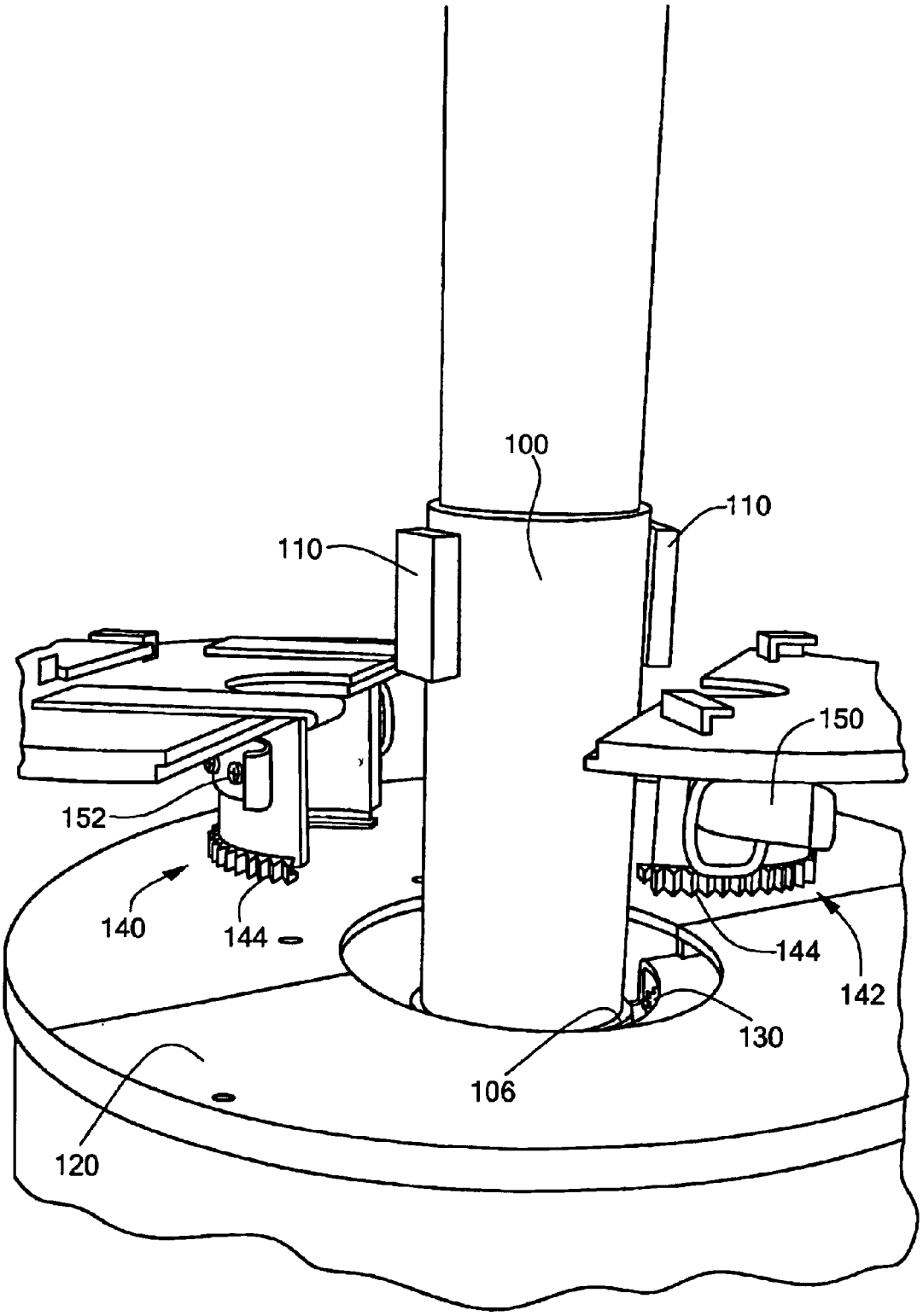
FIG. 8 is a schematic view of the preferred fan blade split drive ring of the subject invention just prior to being rotatably coupled to the split collar shown in FIGS. 4–5.
Figure 9:
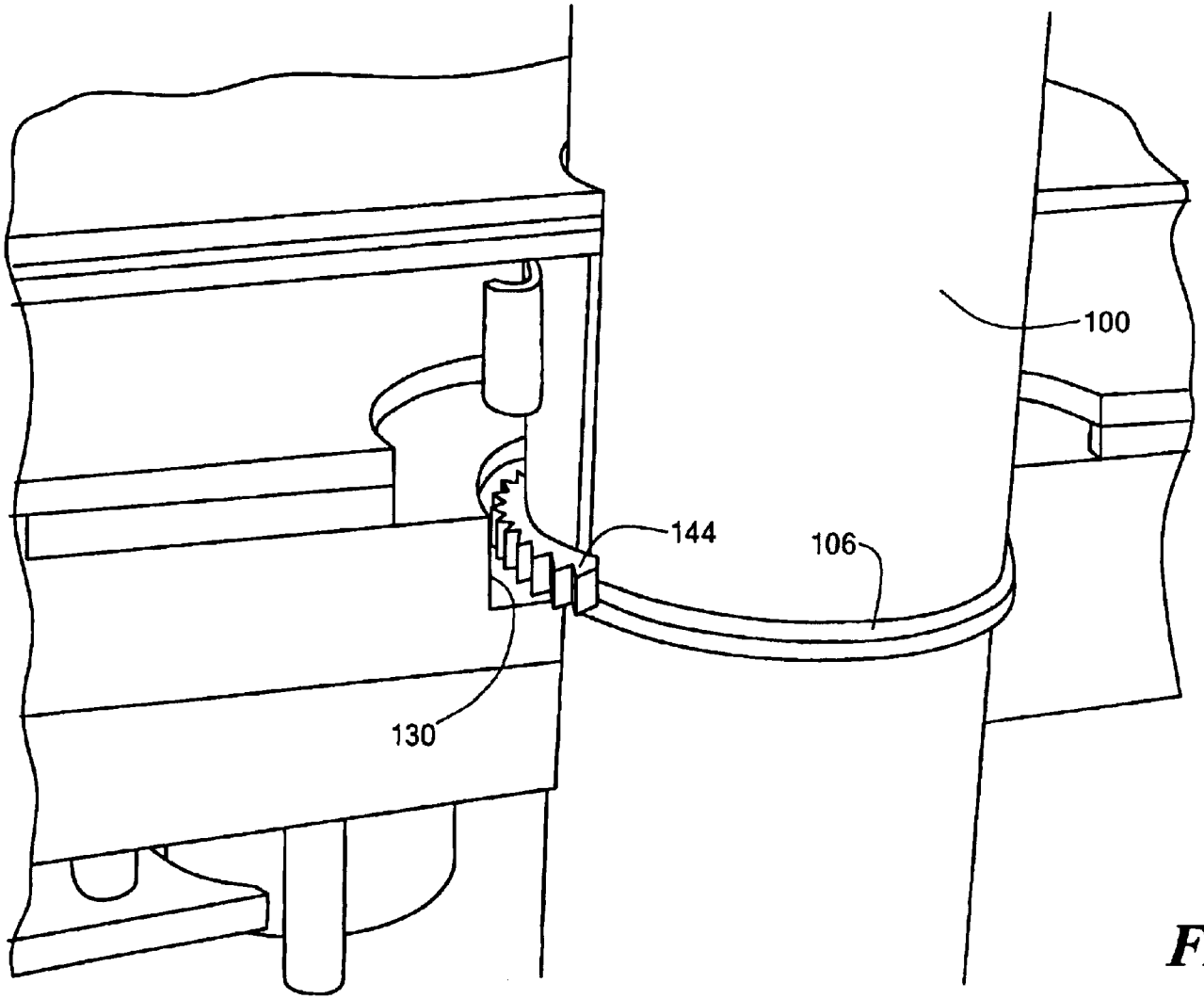
FIG. 9 is a partial schematic view showing the driven gear of the split drive ring of FIG. 8 resting on the split collar drive ring support and engaging the motor housing drive gear.

As also shown in FIG. 8, the split drive ring of the subject invention is preferably also in two sections 140, 142 rotatably clampable about split collar 100 and preferably including an integrated driven mechanism typically in the form of gear 144 extending downward as shown and rotatably supported on drive ring support 106 to mesh with drive gear 130, FIG. 9 of motor housing 120. Clasp members 150, 152, FIG. 8 and identical opposing clasp members removably secure split drive ring sections 140 and 142 together in a rotatable fashion about split collar 100.

Figure 10:
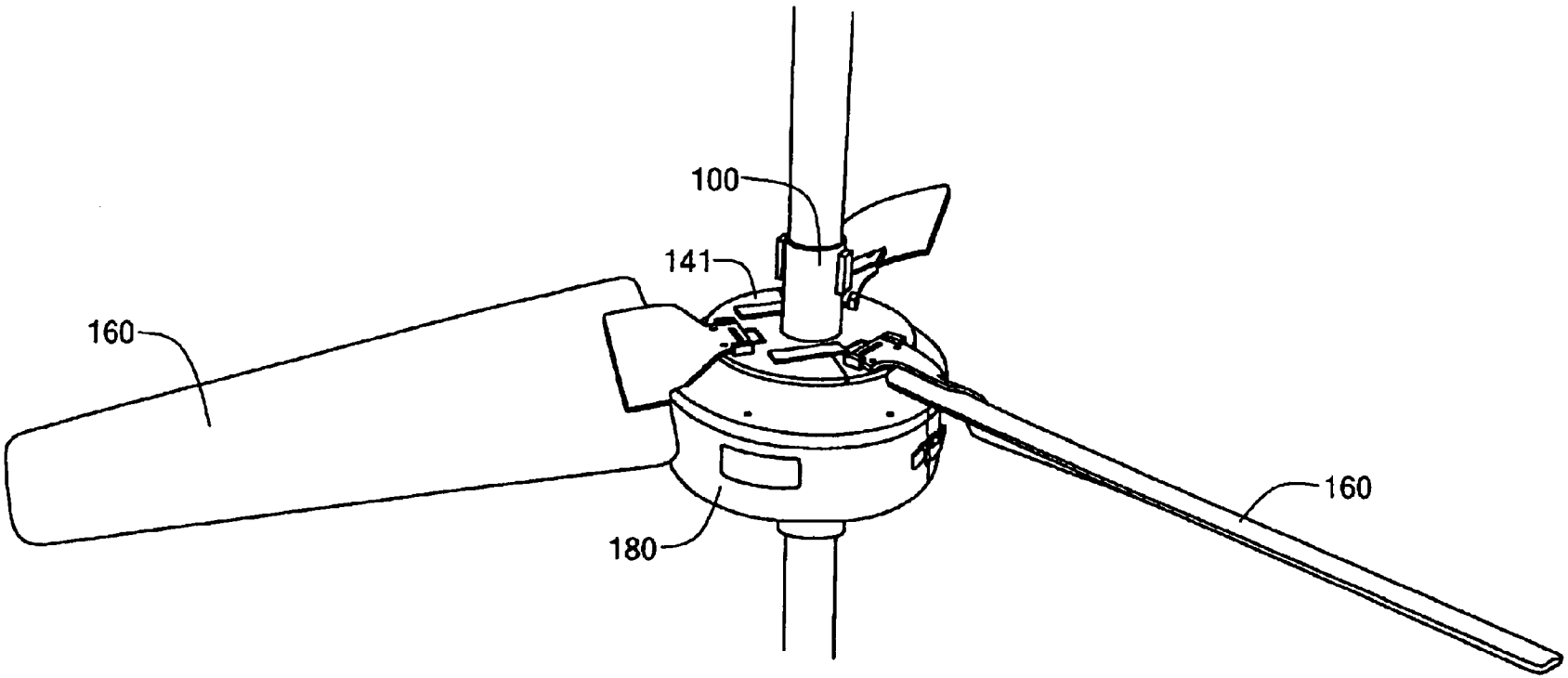
FIGS. 10–11 are schematic views of the complete prototype fan assembly of the subject invention.
Figure 11:
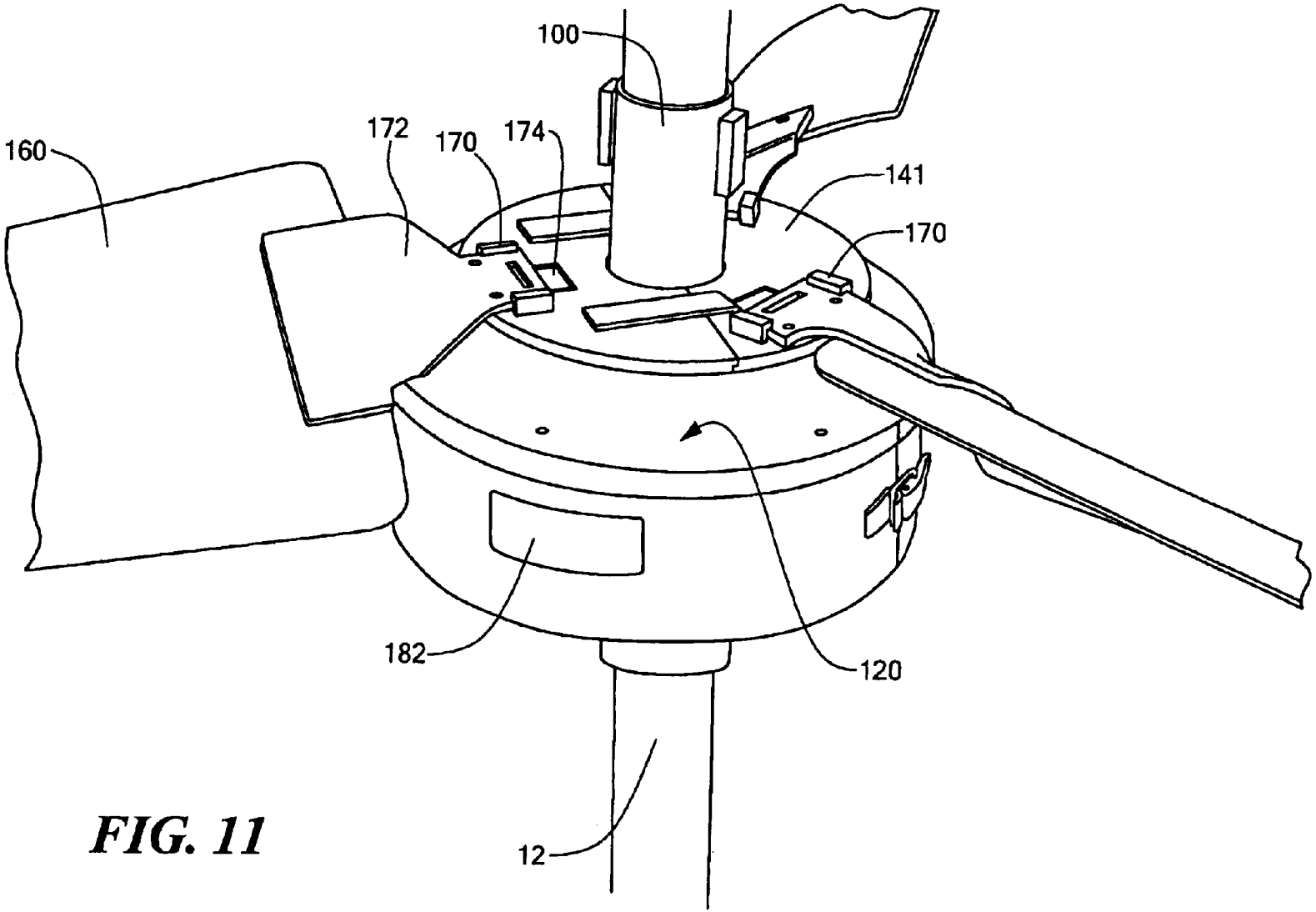

When fully assembled as shown in FIG. 10, split drive ring sections 140, 142, FIG. 8 form complete split drive ring 141, FIGS. 10–11, supported on and rotatable about split collar 100 and driven by the motor within split motor housing 120. Contoured fan blades 160 are coupled to split drive ring 141 preferably by three fan blade blocks 170, FIG. 11 on split drive ring 141 configured to releasably couple fan blades 160 to split drive ring 141. Preferably, each fan blade includes tang 172 received in fan blade block 170 configured to extend the fan blade out over the split motor housing. Tang 172 is also twisted as shown to angle the fan blades as shown in FIG. 11. Upwardly biased spring member 174 formed in the top surface of split drive ring 141 of each fan blade block releasably retains the distal end of each fan blade tang to split drive ring 141 via fan blade blocks 170.

In the prototype shown in FIG. 10, batteries 180 power motor 118, FIGS. 6–7, but, in the production version, six D-cell batteries 118 are typically housed internal to split motor housing 120 behind, for example, hinged door 182, FIG. 11.

Figure 12:
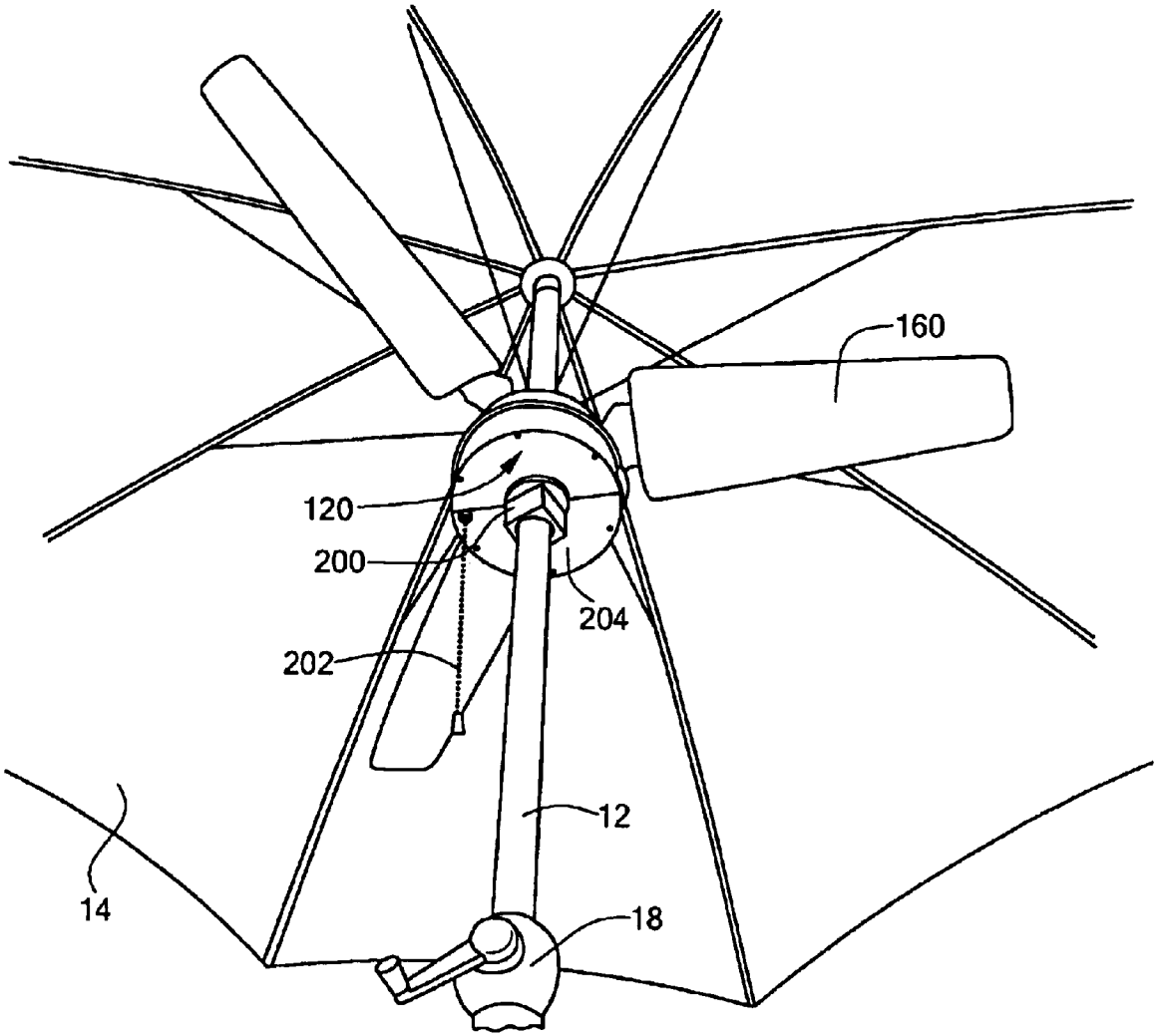
FIG. 12 is a schematic view of the fan assembly of this invention coupled to an umbrella pole.

FIG. 12 shows an embodiment of the subject invention attached to umbrella pole 12 between crank mechanism 18 and the slide for canopy 14. Pull string 202 activates the motor within housing 120 at three separate speeds and also activates a sound card which provides sounds such as birds chirping via speaker 204. Also, additional safety clamps 200 is provided to prevent the whole assembly from sliding down umbrella pole 12.

Figure 3:
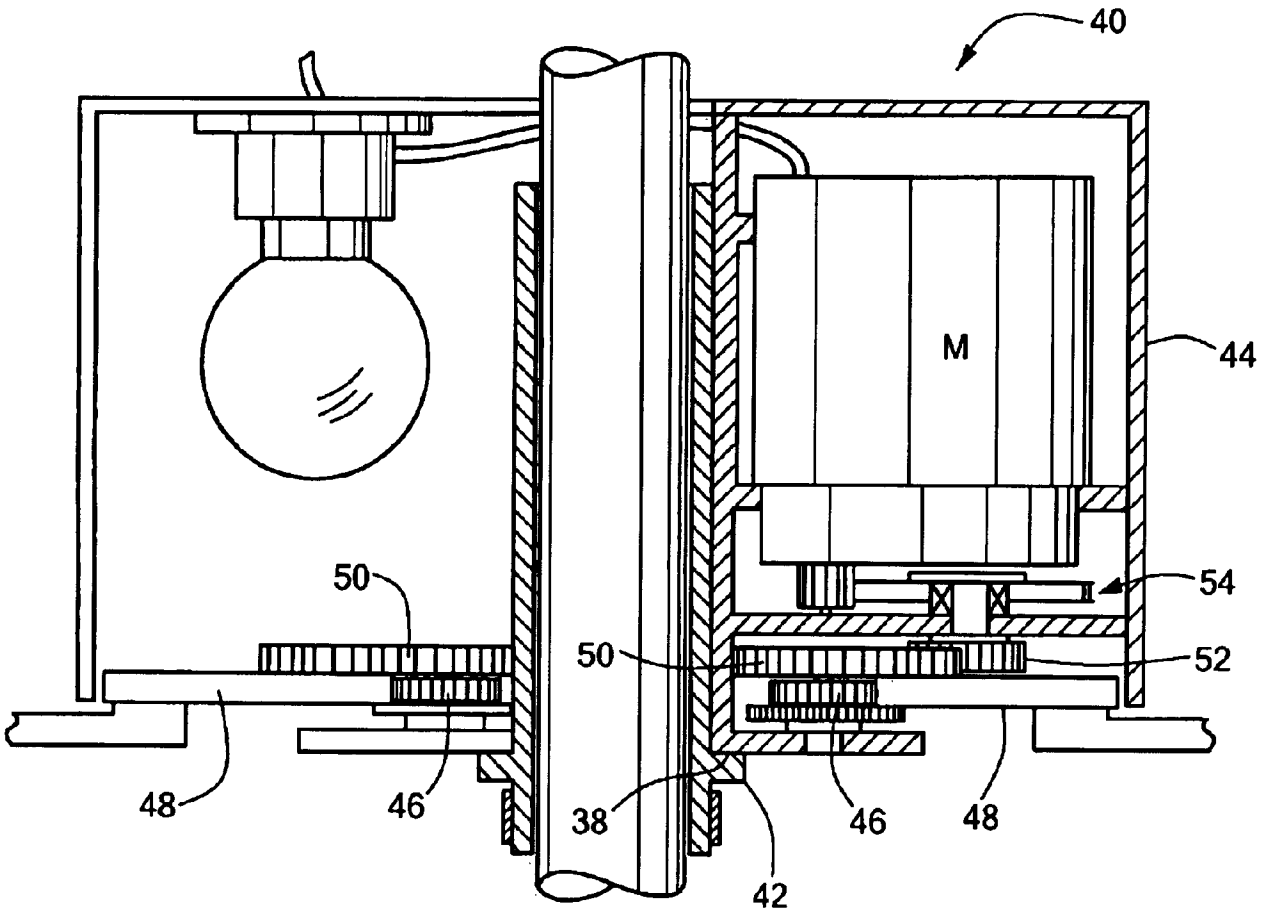
FIG. 3 PRIOR ART
FIG. 3 is a schematic cut away view of another prior art fan assembly.

Because drive gear 144, FIG. 9 of the drive ring is directly supported on drive ring support 106 of collar 100 and directly driven by motor housing drive gear 130, the need for complex and expensive bearings 46, FIG. 3, gear train 54, and large rotatable drive ring drive gear 50 are eliminated resulting in a much simpler, easier to manufacture, and easier to assemble and disassemble after-market umbrella fan assembly.

The fan assembly of the subject invention can be made primarily of plastic components and can thus be sold at a low cost. The fan assembly shown in the figures is universal in design and can be configured to accommodate different umbrella pole diameters and a variety of umbrella configurations. By decoupling clasp members 110, FIG. 5 of the split collar, the complete assembly can be easily slid down the umbrella pole when the umbrella canopy is folded down and not in use and then also easily slid back up the umbrella pole and into position when the umbrella canopy is deployed. During the winter months, the complete fan assembly can be quickly disassembled and stored. Also, fan blades 160, FIG. 11 are easily removed and in this way the umbrella canopy may even be folded down over the fan assembly once the fan blades are removed therefrom. Because the fan assembly is battery operated, it is convenient to use and moreover multiple drive pinions, special gear keys, and bearing assemblies are not required. The result is a self contained, universal, and low cost, umbrella fan assembly which is easy to assemble and which can also be quickly moved down or decoupled from the umbrella pole when the umbrella canopy is folded down.

Although specific features of the invention are shown in some drawings and not in others, however, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. For example, the sub-assemblies disclosed herein may be hingable about the umbrella pole and/or include a slot which receives the umbrella pole therein.

Other embodiments will occur to those skilled in the art and are within the following claims:

What is claimed is:

1. A fan assembly comprising:

a split collar clampable about a pole, the split collar including a drive ring support;

a split motor housing clampable about the split collar, the split motor housing including a drive mechanism;

a split drive ring rotatably clampable about the split collar and directly supported by the drive ring support, the split drive ring including a driven mechanism driven by the drive mechanism; and a plurality of fan blades coupled to the split drive ring.

2. The fan assembly of claim 1 in which the driven mechanism is a driven gear extending downward and supported on the drive ring support.

3. The fan assembly of claim 1 in which the drive mechanism is a drive gear located adjacent the drive ring support.

4. The fan assembly of claim 1 in which the split collar further includes a motor housing support.

5. The fan assembly of claim 4 in which the motor housing support is a circumferential platform extending outwardly from the split collar.

6. The fan assembly of claim 1 in which the drive ring support is a circumferential lip extending outwardly from the split collar.

7. The fan assembly of claim 1 in which the split collar includes two sections.

8. The fan assembly of claim 7 in which each section includes upper and lower clasp members.

9. The fan assembly of claim 5 in which the split collar motor housing support platform includes a cut-out for receiving a motor of the split motor housing.

10. The fan assembly of claim 1 in which the split motor housing includes a motor for the drive mechanism.

11. The fan assembly of claim 10 in which the split motor housing further includes batteries for powering the motor.

12. The fan assembly of claim 1 in which the split motor housing includes two sections.

13. The fan assembly of claim 12 in which each section includes opposing clasp members.

14. The fan assembly of claim 1 in which the split drive ring includes two sections.

15. The fan assembly of claim 14 in which each section includes opposing clasp members.

16. The fan assembly of claim 1 in which the split drive ring includes fan blade blocks for removably coupling the fan blades to the split drive ring.

17. The fan assembly of claim 1 in which each fan blade has a tang connectable to the split drive ring, the tang configured to extend the fan blade out over the split motor housing.

18. The fan assembly of claim 17 in which each tang has a twist to angle the fan blades.

19. The fan assembly of claim 16 in which the fan blade blocks each include an upwardly biased spring member for releasably retaining the distal end of each fan blade.

20. The fan assembly of claim 1 further including a speaker disposed on the split motor housing for producing sounds.

21. The fan assembly of claim 1 further including a safety clamp disposed about the pole below the split collar.

22. A fan assembly comprising:

a split collar clampable about a pole, the split collar including a drive ring support;

a split motor housing clampable about the split collar, the split motor housing including a drive gear;

a split drive ring clampable about the split collar, the split drive ring including a driven gear extending downwardly and directly supported on the drive ring support and driven by the drive gear of the split motor housing; and a plurality of fan blades coupled to the split drive ring.

23. A fan assembly comprising:

a split collar removably clampable about a pole, the split collar including a circumferential drive ring supporting lip extending outwardly from the split collar and a circumferential platform extending outwardly from the split collar forming a motor housing support;

a split motor housing removably clampable about the split collar and supported on the circumferential platform of the split collar, the split motor housing including a drive mechanism;

a split drive ring removably clampable about the split collar and rotatably directly supported by the circumferential lip of the split collar, the split drive ring including a driven mechanism driven by the drive mechanism of the split motor housing; and a plurality of fan blades releasably coupled to the split drive ring.

24. A fan assembly comprising;

a split collar clampable about a pole, the split collar including a circumferential drive ring supporting lip extending outwardly from the split collar and a circumferential platform extending outwardly from the split collar forming a motor housing support;

a split motor housing clampable about the split collar and supported on the circumferential platform of the split collar, the split motor housing including a drive gear located adjacent the circumferential drive ring supporting lip of the split collar;

a split drive ring clampable about the split collar and including a driven gear driven by the drive gear of the split motor housing and directly supported on the circumferential drive ring supporting lip of the split collar; and a plurality of fan blades coupled to the split drive ring.

25. A fan assembly comprising:

a split collar formed in at least two sections, each section including opposing upper and lower clasp members for releasably clamping the split collar about a pole, the split collar including a drive ring support;

a split motor housing formed in at least two sections each section including opposing clasp members for releasably clamping the split motor housing about the split collar, the split motor housing including a drive mechanism;

a split drive ring formed in at least two sections, each section including opposing clasp members for rotatably clamping the split drive ring about the split collar, the split drive ring including a driven mechanism driven by the drive mechanism of the split motor housing, the split drive ring directly supported by the drive ring support of the split collar; and a plurality of fan blades coupled to the split drive ring.

26. A fan assembly comprising:

a collar clampable about a pole, the collar including a drive support;

a motor housing clampable about the collar, the motor housing a battery powered motor operated drive mechanism;

a drive ring clampable about the collar and directly supported by the drive ring support, the drive ring including a driven mechanism driven by the drive mechanism of the motor housing; and a plurality of fan blades coupled to the drive ring.

27. A fan assembly comprising:

a collar clampable about a pole, the collar including a drive ring support;

a motor housing clampable about the collar, the motor housing including a battery powered motor operated drive gear;

a drive ring clampable about the collar, the drive ring including a driven gear directly supported on the drive ring support and driven by the drive gear of the motor housing; and a plurality of fan blades coupled to the drive ring.

* * * * *